US009314068B2

(12) United States Patent
Schmutte

(10) Patent No.: US 9,314,068 B2
(45) Date of Patent: Apr. 19, 2016

(54) SELF-CUSTOMIZED, MOLDABLE, WEIGHT-DISTRIBUTING INSERT FOR BALLET POINTE SHOES

(76) Inventor: Kelly Susan Schmutte, Davis, CA (US)

( * ) Notice: Subject to any disclaimer, the term of this patent is extended or adjusted under 35 U.S.C. 154(b) by 1103 days.

(21) Appl. No.: 13/096,852

(22) Filed: Apr. 28, 2011

(65) Prior Publication Data

US 2011/0265348 A1 Nov. 3, 2011

Related U.S. Application Data

(60) Provisional application No. 61/330,312, filed on Apr. 30, 2010.

(51) Int. Cl.

| | |
|---|---|
| ***A43B 7/14*** | (2006.01) |
| ***A43B 23/08*** | (2006.01) |
| ***A43B 5/12*** | (2006.01) |

(52) U.S. Cl.

CPC . *A43B 5/12* (2013.01); *A43B 7/145* (2013.01); *A43B 7/1465* (2013.01); *A43B 23/086* (2013.01)

(58) Field of Classification Search

CPC ..... A43B 7/14; A43B 7/145; A43B 7/1465; A43B 7/26; A43B 13/41; A43B 23/08; A43B 23/081; A43B 23/086; A43B 23/087; A43B 5/12; A43B 3/10; A43B 3/101; A43B 3/106

USPC ..... 36/8.3, 72 R, 75 R, 77 R, 77 M, 88, 36/93–95, 98, 113, 140, 154, DIG. 2; 12/142 D, 142 N, 142 P, 142 R, 146 B, 12/146 D, 146 R; 425/2; 602/30

See application file for complete search history.

(56) References Cited

U.S. PATENT DOCUMENTS

| | | | |
|---|---|---|---|
| 1,525,848 | A | 2/1925 | Bonaventure |
| 1,704,281 | A | 3/1929 | Salvatore |

(Continued)

FOREIGN PATENT DOCUMENTS

| | | | |
|---|---|---|---|
| EP | 136415 | A1 * | 4/1985 |
| FR | 2660168 | A1 * | 10/1991 |

(Continued)

OTHER PUBLICATIONS

Shepherd, Lesley. About.com: "Use Two Part Silicon Mold Putty to Make Easy, Simple Molds". Jul. 25, 2007. URL: <http://miniatures.about.com/od/miniaturebasics/p/silmoldputty.htm?p=1>.*

(Continued)

*Primary Examiner* — Alissa L Hoey
*Assistant Examiner* — Jameson Collier
(74) *Attorney, Agent, or Firm* — Carr & Ferrell LLP

(57) ABSTRACT

A customizable pointe shoe insert is provided. Such an insert achieves a "perfect fit" that is customized to each dancer's foot by using a moldable material to substantially fill the voids within the box of the shoe, so weight is optimally distributed across a greater percentage of the surface of the forefoot when en pointe. An insert may be constructed from an impression material that when applied, precisely contours itself to the foot and then quickly chemically cures into a rubbery, resilient solid. The design allows a dancer to self-mold the insert and apply the material according to her personal preferences. The insert may further be associated with a fabric covering that serves to hold the moldable material in place during molding and/or to provide structural support in areas of thin moldable material. The insert may further be integrated with one or more spacers for positioning in between adjacent toes.

6 Claims, 8 Drawing Sheets

(56) References Cited

U.S. PATENT DOCUMENTS

| | | | | | |
|---|---|---|---|---|---|
| 1,717,659 | A | | 6/1929 | Bunnell | |
| 1,744,122 | A | | 1/1930 | Keeling | |
| RE17,753 | E | | 7/1930 | Haney | |
| 1,813,561 | A | | 7/1931 | Salvatore | |
| 1,819,766 | A | | 8/1931 | Salvatore | |
| 1,953,659 | A | | 4/1934 | Savino | |
| 1,996,083 | A | | 4/1935 | Smith | |
| 2,119,590 | A | * | 6/1938 | MacDonald | 264/152 |
| 2,210,304 | A | | 8/1940 | Poole | |
| 2,503,656 | A | * | 4/1950 | Cone | 128/894 |
| 2,603,212 | A | * | 7/1952 | Zeve | 602/30 |
| 2,810,214 | A | | 10/1957 | Wolfe | |
| 3,168,095 | A | * | 2/1965 | Magee | 602/30 |
| 3,402,411 | A | | 9/1968 | Hanson | |
| 3,797,137 | A | | 3/1974 | Harkness | |
| 3,968,577 | A | * | 7/1976 | Jackson | 36/43 |
| 4,026,046 | A | | 5/1977 | Clark et al. | |
| 4,120,064 | A | | 10/1978 | Salomon | |
| 4,301,564 | A | | 11/1981 | Dalebout | |
| 4,428,089 | A | | 1/1984 | Dawber et al. | |
| 4,520,581 | A | | 6/1985 | Irwin et al. | |
| 4,901,453 | A | | 2/1990 | Gaynor | |
| 5,035,069 | A | | 7/1991 | Minden | |
| 5,111,597 | A | | 5/1992 | Hansen et al. | |
| 5,129,165 | A | | 7/1992 | Woodle | |
| 5,191,726 | A | | 3/1993 | Vallee | |
| 5,469,641 | A | | 11/1995 | Subotic | |
| 5,740,618 | A | | 4/1998 | Minden | |
| 6,705,026 | B1 | | 3/2004 | Arbour | |
| 6,810,603 | B1 | * | 11/2004 | Cosentino | 36/8.3 |
| 6,895,694 | B2 | | 5/2005 | Nye | |
| 7,036,244 | B1 | | 5/2006 | Finch | |
| 7,765,718 | B2 | * | 8/2010 | Wilkenfeld | 36/8.3 |
| 7,827,707 | B2 | * | 11/2010 | Davis | 36/71 |
| 7,951,103 | B2 | * | 5/2011 | Millet | 602/30 |
| 8,181,362 | B2 | * | 5/2012 | Davis | 36/88 |
| 2005/0022421 | A1 | | 2/2005 | Bruckner | |
| 2005/0250620 | A1 | * | 11/2005 | Minuto et al. | 482/49 |
| 2007/0074430 | A1 | | 4/2007 | Coomer | |
| 2007/0199208 | A1 | | 8/2007 | Wilkenfeld | |
| 2008/0034612 | A1 | * | 2/2008 | Palattella | 36/8.3 |
| 2010/0126042 | A1 | | 5/2010 | Wyon | |

FOREIGN PATENT DOCUMENTS

| | | | | |
|---|---|---|---|---|
| WO | WO 02087374 | A1 | * | 11/2002 |
| WO | WO 2004107895 | A1 | * | 12/2004 |
| WO | 2007/113588 | | | 10/2007 |

OTHER PUBLICATIONS

Subotic, Goran, "Perfect Fit", Brochure mailer, Aug. 2000, 2 pages, www.custompointe.com, Mystic, Connecticut.

Inspire the Future of Dance, "Pointe Putty", Website, Accessed May 10, 2012, http://futureofdance.com/index.php?option=com_content &view=article&id=53&Itemid=60, United Kingdom.

Accolade, "Perfect Fit", Pointe Magazine, Aug. 2000, 2 pages, www.custompointe.com, Mystic, Connecticut.

* cited by examiner

PRIOR ART

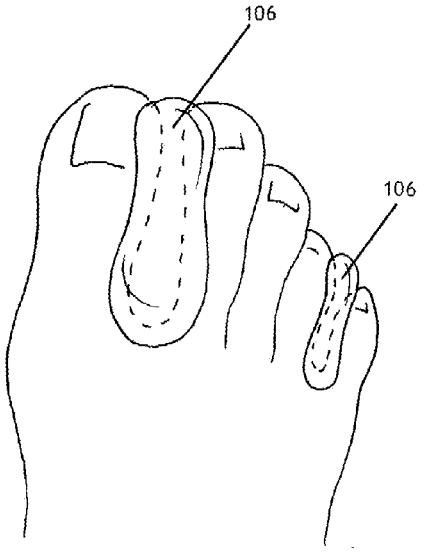
Fig. 13
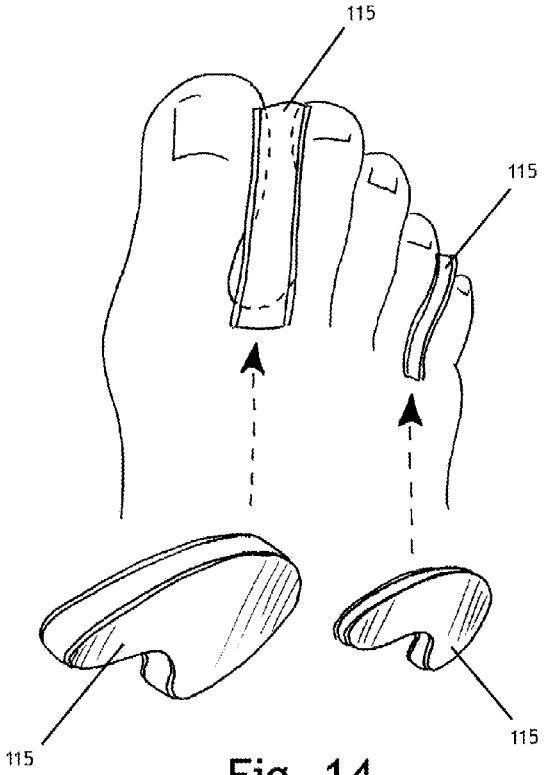
Fig. 14
Fig. 15B
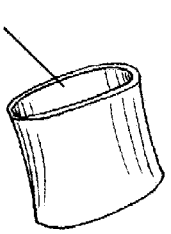
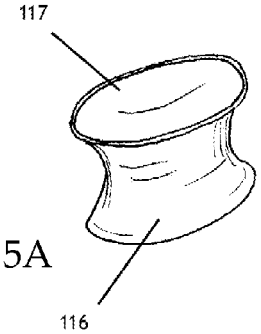
Fig. 15A
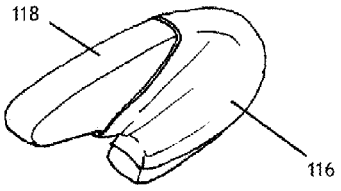
Fig. 15C

SELF-CUSTOMIZED, MOLDABLE, WEIGHT-DISTRIBUTING INSERT FOR BALLET POINTE SHOES

CROSS-REFERENCE TO RELATED APPLICATIONS

The present patent applications claims the priority benefit of U.S. provisional patent application No. 61/330,312 filed Apr. 30, 2010, the disclosure of which is incorporated by reference herein.

BACKGROUND OF THE INVENTION

1. Field of the Invention

The present invention generally relates to ballet footwear. More specifically, the present invention concerns protective toe pads worn inside a ballet pointe shoe, which may include a silicone rubber insert designed to mold to the unique shape and configuration of a dancer's toes, so as to distribute the weight more evenly across a greater percentage of the surfaces of the toes and forefoot while en pointe.

2. Description of Related Art

Pointe shoes are a special type of shoe unique to the art of ballet dancing. As used herein, ballet shoe or shoe refers to pointe shoes. Pointe shoes provide support to a ballet dancer (usually female) when she stands balanced on the tips of her toes ("en pointe"). An icon of a ballerina's ethereal grace and beauty, pointe shoes were invented to create the illusion of lightness and lengthen the lines of the dancer. Although pointe shoes have evolved to become stronger in response to the demands of more rigorous and athletic choreography since they first appeared almost two centuries ago in the early 1800s, pointe shoes have otherwise changed little in their overall design, materials, and method of construction. A traditional pointe shoe provides support to the dancer who is "en pointe" through two basic elements: the box and the shank. The box is the rigid part of the shoe that encases the toes and forefoot, and it is constructed by reinforcing ("blocking") the toe part of the shoe with layers of burlap, heavy paper, canvas, gauze/toile, etc., that are saturated with a special paste or glue. Each manufacturer generally uses a unique combination of materials and a proprietary formula for glue.

Stiffened by the glue or paste, the box lends support to the toes, and if fitted properly, generally hugs the foot across the metatarsal so that the sides of the dancer's foot are held in place. As such, her foot does not merely slide down into the tip of the shoe, which would cause her toes to buckle. A second load-bearing component of the shoe is the shank, which is a stiff insole typically nailed inside the shoe to provide support under the arch of the foot when the foot is en pointe. Generally made from redboard, a stiff cardboard, or even leather, the shank provides the required flexural strength to prevent the dancer's foot from rolling over or falling off pointe, as well as the compressive strength to support the vertical load from the dancer's body weight. Though initially quite stiff and unforgiving when brand new, pointe shoes gradually soften and "break in" over time, molding to the foot, until they reach the point where they are too soft and are considered "dead." The process of "breaking in" may last anywhere from as little as one performance for a professional to several months for a student.

Pointe shoes are generally constructed and formed by hand on a symmetrical last. The pointe shoes are usually tapered to some extent and end in a squared-off flat tip called the platform on which the dancer balances. Unlike almost all other shoes, pointe shoes are formed in exactly the same shape for right and left feet. This was most likely originally for economical reasons during manufacturing, but also for aesthetic and functional reasons: a symmetrical shoe means a longer, straighter line and a wider platform to balance on. However, since right and left feet are so naturally different, such a design radically influences the quality of the fit, and the implications of such a design will be discussed later on.

Pointe shoes need to fit very tightly, almost like a glove, to provide the necessary support, to prevent the foot from sliding in the shoe, and to maximize control. However, the ease of finding a correct fit is extremely difficult; such a process may require the expert assistance of an experienced fitter (which is often hard to find), several hours of trying on shoes in a trial-and-error fashion, and the dancer being willing and able to articulate what she feels accurately. Young dancers, especially beginning 11-year-old students, may not always articulate their needs, either out of fear of embarrassing themselves or uncertainty about what the shoe is supposed to feel like. It is rare that a student continues wearing the same shoe with which she was first fitted. Most dancers eventually embark on an experimental quest for the "perfect" shoe, which often takes many years, if not all of their dance career, to find. Adding to the difficulty of finding a quality fit is the challenge for the retailer (usually a small specialty store) to stock a wide variety of brands, styles, and box shapes.

Despite the existence of many padding options, many dancers continue to suffer pain, discomfort, and eventually, damaged or deformed feet. One significant contributor is the basic challenge of fitting a human foot with its complex asymmetric, organic shape inside a blocky, geometric, and generic-shaped rigid shell. Simply due to the fact that the inner geometry of the shoe and the unique shape of the foot will never match perfectly, there are voids created inside the box of the shoe. Where the forefoot is in contact with the box of the shoe, high pressure points may develop, most commonly on the tip of the big toe (or the second toe if it is the longest toe) and the heads of the metatarsals. As used herein, the forefoot may refer generally to a portion of the foot including and proximate to the toes. The forefoot therefore may encompass one or more toes, including the tips and tops of the toes, as well as the cavity underneath the heads of the metatarsal. The problem created by high pressure points becomes even worse when the dancer is en pointe, for the majority of her weight is now distributed over these localized high-pressure contact points, a greatly reduced surface area from the plantar surface of the foot. Even where a shoe with a suitable box shape for a dancer's foot is used, its ability to completely support the foot by evenly distributing the weight over all surfaces of the forefoot is still limited. Presently, there are no pointe shoes that mold themselves completely to the configuration of the toes inside the shoe. Most fitters generally try to address this issue by fitting the shoe as tightly as possible, essentially forcing the foot to fit the shoe, which only increases the dancer's discomfort. These high pressure points inside the shoe can cause extreme pain for the wearer during dancing, and potentially threaten her with long-term injuries that could shorten her dance career.

Not only does the foot's natural shape not match the inside of a pointe shoe box, but to make matters more complicated, dancers' feet are as different as their faces. Besides differences in foot widths and lengths, which are accommodated by most other kinds of shoes, additional differences such as toe configuration can dramatically affect comfort and fit in a pointe shoe, which is designed for a wholly different kind of weight-bearing. It is estimated that one-third of the population has a second toe longer than the first toe, one-third has a first toe longer than the second, and one-third has both toes the same length. Consequently, where a dancer experiences pain depends entirely on her foot shape and how well it fits the shoe. Pain might be greatest across the metatarsal (on the bunion or tailor's bunion), on the tip of the longest toe, or be localized on any number of joints or knuckles, as well.

The plethora of foot injuries that plague pointe dancers is especially alarming considering that the average student begins pointe work at age 11, and the bones of the feet do not complete their final ossification (hardening and joining) until age 20-23. If the shoe is fit incorrectly, or the dancer does not have well-developed muscles, the force of the dancer's body weight on her feet and toes can cause malformation of the still soft and growing bones and joints. Different types of injuries can result from shoes that are incorrectly fitted either too large or too small. Shoes that are too large (or become too stretched out with use) can cause a dancer's foot to sink into the shoe and her toes to buckle. This can exacerbate bunions, cause hard corns or calluses to develop on toe joints, create blisters, and bruise the toenails (e.g., especially on the first and second toes). Shoes that are too small widthwise can over-compress the heads of the metatarsals and the toes, which can easily produce soft corns between toes, induce bunions, cause ingrown toenails, and even foot conditions such as Morton's neuroma (knotted nerve fibers that cause shooting pains in the ball of the foot). Dancers with a longer second toe have particular problems, and often find their second toe curled at the end of the shoe or buckling en pointe. Toes that are perpetually cramped may also eventually develop a deformity, such as a hammer toe, at which point no corrective exercises or stretching can restore the toe to its original shape.

These extremely painful conditions and potential long-term health hazards for dancers illustrate the dangers of a shoe that creates too many high pressure points on the foot, whether from lack of even support inside a too-large shoe with too many voids or conversely, from compression and jamming inside an overly-small shoe. Unfortunately, these high pressure points can cause significant damage over the long term. Toes and joints may become permanently disfigured if they are bent in ways they are not supposed to be for prolonged periods. Bumps may appear where undue pressure is applied, if the foot is not evenly supported or is forced to take the shape of the shoe. On a biological level, there is an increase in bone tissue where greater mechanical demands are introduced, which explains why the first toe joint may react to increased pressure by enlarging to form a bunion, or why a bone spur can appear on a bone or joint which suffers constant friction and stress. In such a process, a painful enlargement on the outside of the foot, referred to as a "tailor's bunion," can occur on the small toe joint. Surgery is considered a last resort to correct any of these conditions, as even a slightly changed foot might seriously threaten the dancer's career. Embodiments of the present invention seek to provide a healthier environment for the foot in which the pointe shoe hugs all the surfaces of the forefoot evenly so as to more evenly distribute the forces it must bear.

Obviously, preventing long-term damage to the feet is a major concern for all dancers, and especially for professional dancers whose livelihood hinges upon their ability to consistently perform well. However, day-to-day discomfort is equally, if not more of, a concern for dancers than long-term damage. Despite myths about dancers who take pride in suffering in pointe shoes or who proudly show off their bloody feet, most dancers find that pain not only takes the enjoyment out of dancing, but it also removes the ability and motivation to push themselves on a daily basis, thus retarding their growth and strength-building as a dancer. Pain also dramatically reduces the ability to focus on other areas of technique and/or artistry, and thus directly detracts from performance.

From the time that ballerinas first began dancing en pointe, dancers have sought ways to protect their toes and mitigate the pain their art demands. For example, stuffing loose lambswool into the tip of the shoe or weaving lambswool around individual toes were early practices that still continue today. While soft at first, lambswool quickly packs down and becomes flat and hard, providing little support or cushioning.

Dancers through the ages have also worn various types of toe pads, which generally comprise an envelope to cover, protect, and cushion the toes, and which are similar in form to the cut-off toe of a sock. Toe pads or toe caps have been made from such various materials as rubber, fur, lambswool-fleeced fabric, foam rubber, and more recently, gel.

One of the most commonly used toe pads in the art today is a product known as an "Ouch Pouch," which essentially is a thin, fabric-covered gel envelope for the toes (about ⅛" uniform thickness throughout). While many dancers choose "Ouch Pouches" or other gel-lined toe pads, some dancers prefer less padding and choose to use something as simple as a paper towel (popular with many professionals).

It is without question that no one padding solution solves all problems for dancers. However, current padding solutions fail in at least three critical ways. First, by only providing one thin covering of uniform thickness, existing toe pads fail to address the natural disparity between the shape of the foot and the shape of the shoe, and thus do nothing to improve either the fit of the shoe or weight distribution inside the shoe. Secondly, such padding may not be suitable for dancers of all foot types, since individual dancers have unique needs for support based on the shape and toe configuration of their feet. For both of these reasons, a custom fit is crucial for ballet pointe shoes, because the entire weight of the dancer's body is distributed over a very small area, and a solution that is capable of adapting to the unique shape of the foot and toes will most efficiently maximize this area.

Third, existing padding solutions (including toe pads as well as other padding accessories) are designed to take a reactive approach to pressure points, that is, they seek to reduce pressure points inside the shoe by introducing additional cushioning or protective material to the area in pain. For example, students might choose to wear a gel toe pad with an exceptionally thick layer of gel in the big toe area, put a gel-lined elastic cap over their abused big toe, slide gel-lined sleeves over blister-prone knuckles, or use the ever-useful white athletic tape or masking tape to wrap tender toes or cover bony protrusions. However, a proactive approach of minimizing the high pressure points by filling the space around the pressure points, thus creating more even weight distribution, would solve many of these problems from the very beginning. Beyond being less effective in actually reducing targeted pressure points, padding products that operate from a reactive framework also create the additional problem of interfering with the dancer's level of control in the shoe. Though dancers generally have different preferences about what works best for them, most dancers and all teachers agree that padding should not interfere with the dancer's connection to the floor. Dancers often speak of needing to "feel the floor," meaning both feel the ground underneath their toes while en pointe, as well as feel the ground underneath the balls of their feet while massaging the floor in a tendu. Though there are a few varieties of gel pads offered that provide a very thick (upwards of ⅜") layer of cushioning under the big toe, they are typically highly discouraged by teachers and even dancers because they make it difficult to feel grounded. It is hard to have control over the shoe and be able to balance with confidence if a dancer feels as if she is levitating off the ground on a waterbed. Tradition, as far as padding goes, holds that less is more.

Although the idea of a customized, weight-distributing shoe or device may not be completely new to the art, the particular implementations in the market (or lack thereof) are fraught with numerous shortcomings, especially in the tradition-bound world of ballet.

For example, some currently available shoes may include built-in padding in the box of the pointe shoe. For example, U.S. Pat. No. 4,901,453 to Gaynor (filed Mar. 18, 1988) and U.S. Pat. No. 5,035,069 to Minden (filed Nov. 20, 1989), both titled "Ballet Slipper and Method of Making a Ballet Slipper," describe a pointe shoe which seeks to address improved comfort. As such, the respective designs incorporate layers of resilient polymeric material lining the upper and lower surfaces of the shank, the interior of the box, and the exterior of the platform. While such foam linings (e.g., the PORON®) do provide some shock-absorption benefit and general cushioning, they actually do very little to make the shoe fit a particular dancer's foot better or to provide better support for the dancer's foot.

U.S. Pat. No. 4,026,046 to Clark et al. (filed Jul. 29, 1976) titled "Dancing Slipper with Self-Molding Toe Insert" describes a design for a pointe shoe which comes with a removable plastic insert that molds to the foot when heated. The insert is made of ethane vinyl acetate, which is boiled for a minute before being applied to the foot, similar to mouthguards in sports applications. Although it is designed to redistribute the weight and remove pressure from the big toe, the process of producing such an insert (i.e., through boiling) is rather clinical and technical, which makes it difficult to incorporate into the normal routines of ballet dancers. More importantly, though, ethane vinyl acetate is neither very resilient nor forgiving, instead being rather hard and uncomfortable. Such an insert additionally creates problems of perspiration.

U.S. Pat. No. 5,129,165 to Woodle (filed Oct. 30, 1990) titled "Custom Toe Cap for Ballet Pointe Shoes and Method of Weight Distribution" describes a silicone rubber-based custom toe cap which is molded to fit the tips of the shorter toes to provide more even weight distribution across the tips of all the toes. Woodle, a self-described podiatrist who creates these toe caps as part of his practice, explains that the toe caps can be fabricated by molding a putty-like settable compound about the bare ends of the shorter toes, slipping a plastic bag over the foot, and then putting the shoe on. The dancer stands en pointe for 10 minutes, and then on flat for 10 minutes while the material cures. The resulting toe cap can be trimmed as necessary, removing excess material from the top and bottom of the toes. Such a toe cap may provide firm support, but with a durometer between 20 and 40 on the Shore-A Hardness scale, the toe cap may also be more yieldable and comfortable than designs such as Clark's. Woodle's toe cap is limited, however, to the tips of the toes and ignores all other surfaces of the forefoot that may be available for even further equalizing the dancer's weight. The more surface area utilized, the greater the reduction in pressure (Pressure=Force/Area). As noted above, while many dancers feel the greatest concentration of pain in their longest toe, an equal number may also suffer significant pain on a bunion, on the side of their big toe knuckle, or on any other protrusion on their foot. Woodle's design seems targeted toward helping the first category of dancers in providing a toe cap, but does not fully address the issue of how to relieve pressure points other than the big/longest toe inside the pointe shoe, and thus is limited in its usefulness. Another problem with Woodle's solution is that mixing the compound with a few drops of curing agent is neither user-friendly nor accessible to individuals without any particular expertise or experience in molding toe caps. Finally, another issue is that the resulting toe cap must be held in place by tape or the dancer's tights. Many dancers prefer to not wear tights inside their pointe shoes, however, and in this case, the extra step of needing to tape on the toe cap is time-consuming and inconvenient.

In another example, U.S. Pat. No. 5,469,641 to Subotic (filed Jan. 30, 1995) titled "Custom Ballet Pointe Shoe," a custom shoe is described that, in comparison to Woodle's toe cap, utilizes more surfaces of the forefoot than simply the tips of the toes, though the method for creating it is even more complicated and difficult. A pointe shoe is described which is designed to distribute the weight more evenly across all the toes and the top of the foot by injecting polyurethane foam or any other curable compound into the box. This cavity is enclosed by an impermeable liner (with an absorbent layer on the side facing the foot), and is accessed by a small injection hole in the platform of the shoe (to be covered by moleskin afterwards). One disadvantage of any kind of liner or skin acting as a barrier between the moldable material and the foot is that it can restrict the movement of the moldable material (e.g., to flow between and behind the toes), thereby resulting in wrinkles that can be irritating to the foot. Subotic also explains that the dancer should let the foam/material cure while standing flat for 40 minutes. Absurd time constraints aside, such a design is even more culturally incompatible than Clark's boilable insert and less user-friendly than Woodle's toe caps. Injectable shoes or boots may be common in the performance sports industry, but such a concept does not address the specific needs of ballet dancers. Additionally, the presumed expense, required mixing and injection equipment, and supervision of the process by a fitting specialist, would rule out such a solution from being easily accessible to dancers as a self-fitted, mass-customized solution.

In another example, U.S. Pat. No. 5,740,618 to Minden (filed Sep. 20, 1995) titled "Dynamic Toe Shoe Box Liner for a Pointe Shoe," the design is partially successful in more evenly redistributing the dancer's weight, but falls short of providing a truly supportive, individualized fit for each uniquely shaped foot. The design comprises a set of "fast resistance" polyurethane foam pads that compress when the foot is standing flat, and expand to maintain a snug fit when the foot is en pointe. There is a trapezoidal piece that lines the whole box, two smaller strips for either side (used solo or in conjunction with the larger pad), as well as a crescent pad to support the shorter toes for dancers with a longer second toe. While the flexibility afforded the dancer to add or remove pads as desired offers customization, the uniform 1/16" thick pads are no more helpful in contouring to the unique shape of the toes and foot than a gel "Ouch Pouch".

In a final example, U.S. patent application publication US 2005/0022421 A1 by Bruckner (filed May 1, 2002) titled "Ballet Pointe Shoe" describes a shoe which is designed to redistribute the dancer's weight more evenly across all the toes through an asymmetrical shoe shell and an ergonomic liner. The shell has a crepe "patten" (build-up) on the outside over the shorter toes to make it look symmetrical (this reduces liner volume). The liner has to be custom-made through an involved casting process, whereby a negative cast of the dancer's foot is taken while en pointe in a "balance sustaining environment" (e.g., standing in a deep sand pit with her feet covered by plaster strips), then a positive mold is made, and then a dense close-celled foam is heat-molded on top. The application fails to explain, however, precisely how the liner's fit with the inner geometry of the box would be achieved. The obvious and most significant flaw with Bruckner's design is that the liner must be individually made for each dancer by way of an involved casting process. Not only would this be a time-consuming and costly process, but the set-up required would likely prevent such a concept from being implemented on a mass scale. Additionally, making a casting of the foot while it is in the "pointe" position will result in a liner that is ill-fitting and uncomfortable when standing or dancing on flat (when the entire sole or even just the ball of the foot in contact with the ground). To make a liner that will accommodate both of these positions, the dancer must alternate between the two during the casting process so that the resulting impression is a blend of the two.

Based on the understanding of the current array of problems related to the fit and wearing of pointe shoes, as well as a survey of prior solutions in the art, it is clear there is an immense need for innovative solutions that deliver an individualized, customizable fit for all dancers. Specifically, there is a need for a pointe shoe insert which addresses such issues as: 1.) the disparity between the shape of the foot and the shape of the pointe shoe, and the resulting painful and damaging high pressure points, 2.) the wide variety of foot shapes and toe configurations that must be supported in the "en pointe" position (creating a unique set of pressure points that varies from dancer to dancer), and 3.) the maze of challenges that confront the dancer in the quest for finding the elusive "perfect fit." Additionally, it is imperative that such a solution satisfy these needs in a convenient, quick, and inexpensive manner (e.g., using a simple procedure the dancer can perform herself), without disrupting the traditional and conservative culture of the ballet world.

SUMMARY OF THE INVENTION

Exemplary embodiments of the present invention include systems and methods for customizing an insert for a ballet pointe shoe of a dancer. Such methods may include applying a moldable impression material to a portion of a foot (e.g., a forefoot part of the foot including one or more toes). The applied moldable material may therefore conform to the shape of the particular portion of the foot. Before the moldable material cures, the foot (and applied moldable material) may further be inserted into the ballet pointe shoe of the dancer such that a portion of the applied moldable impression materials conforms to the shape of the ballet pointe shoe. Methods may further include adjusting the foot of the dancer into one or more positions while the applied moldable impression material cures. The applied moldable impression material may therefore fill one or more voids that may appear between the portion of the foot and the ballet pointe shoe while the foot is in one of the positions. Some embodiments further include layering a cover over the applied moldable impression material prior to inserting the foot and applied moldable impression material into the ballet pointe shoe or positioning a spacer between two adjacent toes in the portion of the foot of the dancer prior to applying the moldable impression material to the portion of the foot.

Exemplary systems for customizing an insert for a ballet pointe shoe of a dancer may include a mix for moldable impression material that may be applied to a portion of a foot of the dancer, and a cover for layering over the applied moldable impression material prior to inserting the foot and the applied moldable impression material into the ballet pointe shoe of the dancer. Some systems further include one or more spacers for positioning in between two adjacent toes.

Various embodiments may further include the customized inserts made according to the methods and systems described herein. Such a pointe shoe insert achieves a "perfect fit" by using a moldable material to substantially fill the voids within the box of the shoe, so that weight is optimally distributed across a greater percentage of the surfaces of the toes and forefoot when en pointe. Preferably constructed from a silicone rubber impression material that may be applied in putty form and then quickly chemically cures into a rubbery, resilient solid, such an insert may very precisely contour itself to the foot and especially the toes.

This highly customized fit not only improves day-to-day comfort and reduces long-term damage, but also improves stability, support and alignment inside the shoe. The infinitely customizable nature of the design not only allows for molding to an unlimited number of foot shapes inside any shoe, but also allows the dancer to self-mold the insert and apply the material according to her individual needs and personal preferences (e.g., selecting her own ideal putty volume and placement for her unique foot). Whether applied liberally over the entire forefoot or more selectively around known pressure points (e.g., the bunion), the putty may be held in place wherever needed and given structural support in thin areas by a flexible cover, which may further enable pressure offloading from any number of points inside the pointe shoe, not simply the longest toe. By providing a simple and straightforward self-fitting process, mass customization of the insert may be made possible. The insert may further be seamlessly integrated with one or more spacers in between adjacent toes, so as to prevent the onset of bunions or soft corns, and to eliminate the need for a dancer to wear separate, additional products.

BRIEF DESCRIPTION OF THE DRAWINGS

Embodiments of the present invention may be better understood, and its numerous features and advantages made apparent to those skilled in the art by referencing the accompanying drawings. It will be noted that these drawings represent only one possible embodiment of the current invention, which will vary in appearance from dancer to dancer based on its unique custom-fitting properties. For ease of understanding and simplicity, common numbering of elements within the illustrations may be employed where an element is the same in different drawings.

FIGS. 10A-10C provide three examples of how the moldable impression material can accommodate an infinite variety of toe configurations (e.g., tapered toes, longer second toe, and square toes) to distribute the dancer's weight more evenly across a greater percentage of the surface area of her toes and her forefoot. Also illustrated are several potential ways to integrate spacers into the insert depending on the individual's foot anatomy and unique needs.

FIG. 13 illustrates a first step in the process of customizing an insert in accordance with an exemplary embodiment of the present invention: determining the need for, and placement of, spacers between adjacent toes. FIG. 13 further illustrates one possible embodiment of spacers: custom-molded spacers from moldable impression material.

FIG. 14 illustrates a second possible embodiment of spacers: pre-formed spacers designed to interface with the moldable impression material. The spacers illustrated in FIG. 14 are made from fabric-faced silicone gel.

FIGS. 15A-15C illustrate a third possible embodiment of spacers: pre-formed silicone gel spacers that have been covered by a stretch fabric sleeve. When stretched over different styles of spacers, the sleeve may further provide a surface to which the moldable impression material can adhere.

As illustrated in FIG. 23, the insert has been customized for a left foot and includes custom-molded spacers incorporated between the first/second and third/fourth toes.

DETAILED DESCRIPTION

Figure 1:
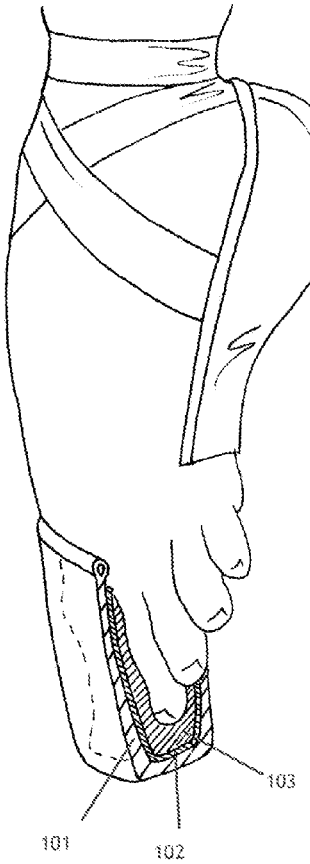
FIG. 1 illustrates a dancer en pointe with the front quarter of her shoe cut away to reveal a cross section of an insert customized in accordance with an exemplary embodiment of the present invention.

In an ideal world, a ballet pointe shoe would provide the dancer with a "perfect fit" that is highly individualized to the shape of her toes and foot, thereby supporting her unique foot shape in a such a way as to protect her health, provide comfort, ensure correct technique, and be further customizable so as to allow the dancer to tweak and perfect the fit in accordance with her own needs. There are myriad problems related to achieving such a "perfect fit": 1.) the natural disparity between the shape of the foot and the shape of the pointe shoe, 2.) the wide variety of foot shapes and toe configurations that must be supported in the "en pointe" position, as well as the unique set of painful and damaging high pressure points that vary from dancer to dancer, and 3.) the maze of challenges that confront the dancer during the in-store fitting process, which may range from the fitter's inexperience to the lack of guidance to the limited selection of stock shoes. Finding the right shoe has significant effects on the day-to-day comfort, as well as on prevention of long-term damage to the developing dancer's young feet, her performance, her development of good technique, and her ability to enjoy her art.

The various embodiments of the present invention resolve the above-cited problems and achieve a "perfect fit" by using a moldable material to adapt the foot to fit the inside of the shoe like a glove, substantially filling the voids within the box of the shoe, so weight is optimally distributed across a greater percentage of the surfaces of the toes and forefoot when en pointe, and painful and damaging pressure points are removed. Embodiments of the present invention not only achieve this elusive critical fit, but also make the process more foolproof (e.g., mitigating faulty decisions made by the fitter or the limited availability of certain shoe models), faster (accelerating the time it takes to find this "perfect fit" over the course of a dancer's life), more accessible for the masses (allowing any dancer to self-fit by a simple, convenient, and economical process), and more comprehensive (e.g., incorporating spacers as necessary to further improve the damage-prevention aspect of the insert and combining two formerly separate products into one). Furthermore, these goals may be accomplished without disrupting the traditional, conservative culture of the ballet world by assuming the familiar form of the already well-known and widely accepted toe pad, as well as using a simple, non-technical fitting procedure.

The "perfect fit" provided by the insert may be established over the course of a simple process. First, the dancer may decide whether she requires spacers between adjacent toes (particularly between her first and second toe), according to the size of natural pre-existing spaces between her toes. The dancer may either mold a custom spacer for these areas first, or insert a pre-formed spacer. Next, the dancer may then prepare an impression material for molding (e.g., silicone rubber based putty) and then apply the moldable material generally over the tips and tops of her toes, paying attention to cover any known pressure point areas (e.g., the bunion). If she so desires, she can limit the application to only certain known pressure areas for a more "minimalist" insert or opt for a more comprehensive putty application that would more thoroughly maximize the available weight-bearing surfaces of the foot and yield a more supportive insert. A lightweight covering (e.g., fabric) may then be layered over the putty material, followed by a protective covering (e.g., plastic bag) to protect the shoe interior, and then the shoe is slipped on. Finally, the dancer alternates between standing en pointe and on flat for approximately 5-8 minutes while the putty flows to the voids within the box of the shoe and continues to self-adjust and equalize pressure until the material cures. Rolling through demi-pointe on the way to full pointe and walking around on flat will ensure that the resulting impression does not simply feel like a static cast of the toes in a single position, but rather a comfortable blend of positions that is unnoticeable whether en pointe, on flat, or rolling through demi-pointe. Once the material is cured, the shoe and insert are removed, and the excess volume (now a cured mass) that escaped from the throat of the shoe is trimmed, and the inserts are ready to wear. The dancer now has a completely customized insert to adapt her unique foot to fit the inside of the shoe precisely, which will offer unparalleled comfort and support.

By very precisely molding to the contours of the foot and substantially filling the voids within the box of the shoe, the moldable material permits a highly customized fit, which the dancer can further tailor to her individual needs (e.g., by selecting both the ideal putty volume and placement for her unique foot). While the concept of filling the voids for more even weight distribution may not be new, the properties of the moldable material, as well as the ability to selectively apply the same as appropriate for the individual dancer, provide a more tailored solution than anything in the prior art. Because the moldable material in its uncured state is an uncontained viscous, fluid, or putty-like composition in direct contact with the foot, such molding material is infinitely moldable and customizable to the exact contours of the toes/foot. Such malleability allows the moldable material to not only fill and conform to the large voids, but also the smaller, shallow voids dispersed throughout the box: in between the toes, around the bunion area, between the vamp and the metatarsals, and even behind the toes in the cavity between the pads of each toe and the heads of the metatarsals.

The dancer may choose to apply the moldable material very selectively in smaller volumes in specific areas for a more "minimalist" approach, or more comprehensively, in which larger volumes are applied generally and liberally over the whole forefoot. Such flexibility and customizability allow the product to be universally useful to any dancer, as it allows for personalized targeting of any number of specific pressure points a dancer may have, while taking advantage of any available weight-bearing surface of the toes and forefoot to do so. This ability to take advantage of any surface (e.g., potentially all or most of the forefoot) greatly improves overall weight distribution by using greater surface area. Generally, the more moldable impression material that is used (e.g., to fill most of the voids in the shoe box), the better the overall weight distribution can be, and the more supportive the finished insert can feel. The dancer's choice in selecting an ideal moldable material volume and placement for her foot, along with the freedom of the moldable material to provide such a high-resolution mold of the foot, combine to increase and potentially maximize the available weight-bearing surfaces of the foot, which is the key to the weight-distributing success of the design. In contrast, Woodle's design was limited by the narrowness of its application to the toes and complexity in formulation; Clark, Subotic, Minden, and Bruckner's designs are limited by the ability of the material (or its container/skin) to freely flow and fill even the shallowest voids and contours within the shoe.

In some cases, a more thorough molding of the foot can be facilitated through use of a simple flexible supportive cover (e.g., fabric) that is applied over the moldable material subsequent to application over the toes/forefoot but prior to insertion into the shoe in the molding process. The supportive cover provides structure and support to the molding, which may otherwise be thin, delicate, and in some cases, in multiple pieces. In addition, the supportive cover may further help hold the insert in place on the foot in subsequent uses. As such, no tape or tights are required to hold the insert (and pieces thereof) in place on the foot. Since the moldable material may impregnate and bond to the fabric during the molding stage, even the thinnest, most fragile areas of the molding may be reinforced. Similar to the relationship between a canvas and paint, thicker applications of the moldable material might remain as one piece, but areas with the thinner applications would likely break off and be lost, if not bound in place (e.g., by a supportive cover). Those thinner parts of the molding (e.g., along subtle contours, on the side of the big toe, over the knuckles of the shorter toes), as well as the parts that might be separated from larger masses (e.g., the peaked ridge that often forms on the underside of the toes) would either need to be trimmed, eventually rip off over time, or become separated without the underlying connective tissue and support provided by the cover. Beyond subtracting valuable surface area for weight-bearing, trimmed or ripped moldings may further leave certain parts of the foot exposed, as well, which could easily contribute to the formation of blisters.

The success of this silicone rubber impression material, including that supported by a supportive cover, in generating a perfect void-filling, weight-distributing environment through this highly customized fit creates a multitude of benefits: vastly improved comfort, long-term health, stability, ankle and toe alignment, support, and control. Besides the comfort and long-term injury prevention associated with having more surfaces of the foot in contact with the shoe, as has already been discussed extensively, another major benefit is greater stability and correct ankle alignment. Many beginning dancers tend to "sickle out" when en pointe, that is, center their weight more over their small toe, rather than correctly between their first and second toes. Letting their ankles bow outward is an improper technique that could cause additional health problems. However, if all the toes feel evenly supported, the dancer is more likely to feel stable and correctly center her weight over the first two toes. The insert can also promote correct toe alignment if the dancer is mindful of keeping her toes lengthened during the molding process. Many dancers tend to curl their toes, which is not only incorrect technique, but is also the source of callused knuckles. A correctly molded insert acts like a retainer or training brace, reminding the dancer to keep her toes straight. The insert could even potentially be used as a diagnostic tool to see exactly what the toes are doing inside the shoe, and help the teacher instruct the student on how she could correct or improve her toe alignment. By substantially filling the void between the top of the foot and the vamp of the shoe, as well as behind the toes, the insert also helps the dancer achieve the feeling of being "lifted" and training her in the correct technique of "pulling up" out of her shoe. This support becomes especially necessary as the shoe begins to break down. Also, because the insert only adds material in the shoe where voids are present, no additional padding is introduced under the big toe or at other high pressure points (and perhaps less). This allows the dancer to maintain her connection to the floor and feel confident, stable, and in control. The insert improves the overall fit of the shoe for any toe type, and makes the difficult fitting process more "foolproof" in the case of an inexperienced fitter or a limited variety of stock shoes. Overall, the improved fit increases enjoyment of dancing and improves endurance and performance.

The insert can also be individualized for the masses by allowing the dancer to self-fit. One fitting kit is capable of generating a completely customized insert for any foot type and shoe combination, and molding can easily be done by any dancer on her own, anywhere. The convenient molding process requires no specialized tools, and the preparation of the moldable impression material is as simple as mixing two different-colored putties together until the colors blend (e.g., so no curing agent is required to activate any chemical reaction). Such molding is a practically "foolproof" fitting process; the moldable material is self-adjusting in terms of flowing to the voids within that particular shoe, reducing the dancer's pressure points no matter their location. The moldable material is also self-fitting in terms of volume, as excess molding material simply escapes from the throat of the shoe and is easily trimmed after curing. Not only can such a finished molding avoid feelings of tightness or bulkiness, but it can also prevent the dancer from having to alter her shoe size. The molding process itself is simple and quick (less than 10 minutes) to complete, and utilizes familiar, existing padding routines of dancers. For example, a dancer applies the moldable material to her toes and other pressure points, much as she might have learned to do with lambswool, sponges, or tape. The main difference between the moldable material and these other padding materials, of course, is that the moldable material will flow into and fill all the spaces around the pressure points, thereby much more effectively addressing pressure at those spots than the additional bulk of wool or foam would. Therefore, while the material might be new to the world of ballet, the process of identifying pressure points is not. The molding process described herein is further unlike other prior inventions in the art for molded custom pointe shoes or toe caps, which are generally more time-consuming and involved, utilizing processes that are more foreign and less culturally compatible in the ballet world, as well as requiring the supervision of a person experienced in the process, all of which make it more costly and highly unlikely to be reproducible on a mass scale. Embodiments of the present invention offer a much more user-friendly, economical, mass-customizable, and culturally familiar option.

The incorporation of spacers into the self-customized insert may also yield significant benefit. Many dancers currently wear gel spacers between their first and second toes, or thinner versions for in between any of their smaller toes. Big toe spacers are usually employed to reduce the onset of bunions, especially if the dancer naturally already has a noticeable space between her first and second toe. Overly narrow pointe shoes can aggravate bunions, while a shoe that is too wide will allow the foot to sink and the big toe to curve inward from lack of support, which will also produce bunions. The tight-fitting nature of pointe shoes also sometimes causes soft corns or blisters to form between adjacent toes (particularly the smaller toes), and in this case, a thinner gel spacer or tape is also useful. If spacers were incorporated into a shoe insert, as is described herein, dancers would not only be more likely to wear them (and thus prevent long-term deformities and near-term discomfort), but also less likely to lose them (as is often the case with this small, stand-alone product). There are several means by which spacers can be integrated into the current invention, and it will be understood that any method that effectively uses a material to space out adjacent toes and that is built-in to the molded insert body is considered to be within the scope of the invention.

One possible embodiment includes using the same silicone rubber impression material as the main body of the insert (or a similar, lower durometer formula) to fashion custom spacers. The dancer may, for example, mix and apply the putty between her toes and allow it to cure with her foot outside the shoe before proceeding with the molding process for the rest of the insert, so as to prevent the space from collapsing and the material from vacating the space when the foot is inserted in the shoe. It is also possible to let the moldable impression material naturally form very thin "spacers" between adjacent toes during the molding of the actual insert. These thin walls are very effective at reducing blistering between neighboring toes, and can substitute as a faster, more convenient alternative to taping individual toes. Another possible embodiment for spacers includes using a pre-formed, external spacer of a different material to which the silicone rubber putty would then adhere. Possibilities include a typical gel spacer whose surface has been prepared for adhesion (e.g., by bonding fabric to either side, creating a rough "sandblasted" surface, perforating the spacer, slipping a fabric sleeve over the top, etc.). A porous spacer, such as a sponge, which the putty could actually impregnate, but would hold the space open, could also be utilized.

Referring now to FIG. 1, a dancer's foot is illustrated en pointe wearing a traditional pointe shoe. The front quarter of the shoe is cut away to reveal the position of the dancer's toes en pointe and to illustrate how the present invention relates to both the inside of the shoe and the dancer's toes. Inside the pointe shoe box 101 (illustrated as one layer for purposes of simplicity, though in fact the box is a multi-layered construction), are illustrated the supportive cover 102 and an insert made of a moldable impression material 103. In a preferred embodiment, the moldable impression material may be a silicone rubber curable compound to be discussed in detail below. The moldable impression material 103 performs most of the critical function of filling in the voids within the box of the shoe so that the weight-bearing potential of all surfaces of the forefoot may be maximized and the dancer's weight may be more evenly distributed. Without the moldable impression material 103, the brunt of the dancer's weight would be borne by her longest toe, as well as any knuckles or joints in contact with the sides of the shoe.

Figure 2:
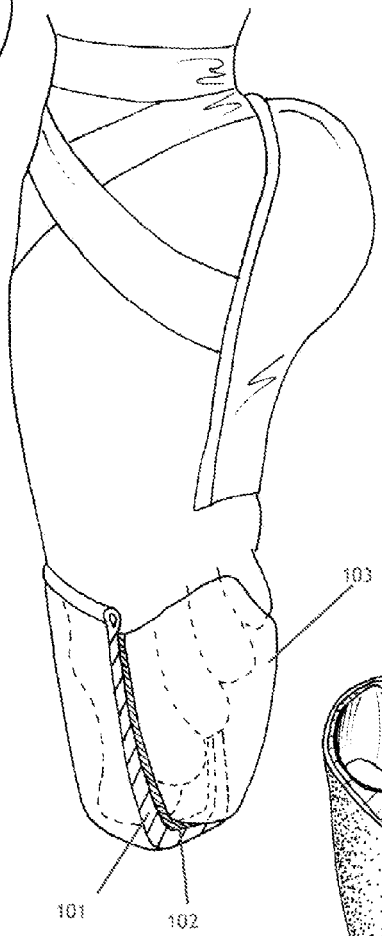
FIG. 2 illustrates a dancer en pointe with the front quarter of her shoe cut away to reveal an insert customized in accordance with the present invention. The partial cross section illustrates how the insert extends over the tops of, under the tips of, and behind the shorter toes in a tapered toe configuration to substantially fill the voids within the box of the shoe.

FIG. 2 also illustrates a dancer's foot with a portion of the shoe cut away to reveal the outline of the moldable impression material 103 that is part of the insert. Looking at both the outline of the single cured mass of moldable impression material 103 in FIG. 2 and the cross section of the moldable impression material 103 under the second toe in FIG. 1, it is evident how the moldable impression material 103 would flow over the tops of, under the tips of, and perhaps even behind the shorter toes to provide support. FIGS. 1 and 2 illustrate a typical example of the form the moldable impression material 103 might assume for a foot with a tapered toe configuration, creating a glove-like fit that distributes the dancer's weight more evenly over her entire forefoot rather than a few painful high pressure points.

Figure 3:
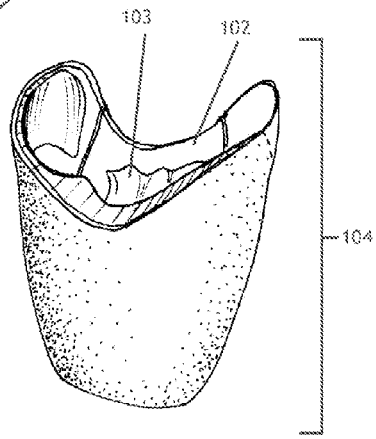
FIG. 3 illustrates a perspective view of an insert customized in accordance with an exemplary embodiment of the present invention and oriented in the "en pointe" position, revealing a partial interior view of the cured moldable impression material inside the insert.

In FIG. 3, the molded pointe shoe insert 104 is illustrated as it might appear in its entirety outside of the shoe. It is apparent how the insert naturally molds itself to perfectly match the inner geometry of the pointe shoe (as well as the complex topography of the foot and toes themselves, as will be better illustrated shortly).

Figure 4:
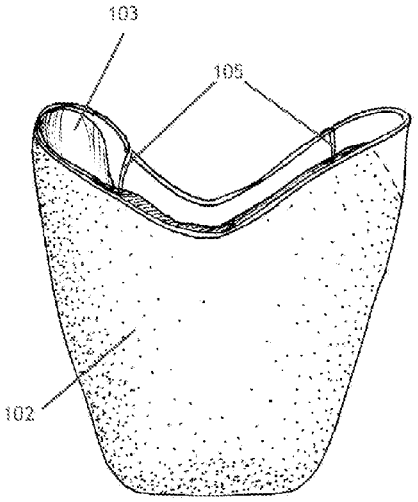
FIG. 4 illustrates a front elevation view of an insert customized in accordance with an exemplary embodiment of the present invention and oriented in the "en pointe" position. The dotted region indicates one possible example of the location of the moldable impression material on the inside of the supportive cover after the molding process. The dotted region illustrates how such a supportive cover may become impregnated with the moldable impression material while the material flows and cures, and how the supportive cover forms a support structure for the molded insert and a means of keeping the insert correctly positioned on the foot. The insert of FIG. 4 is illustrated as having been molded for a tapered toe configuration on a left foot.
Figure 5:
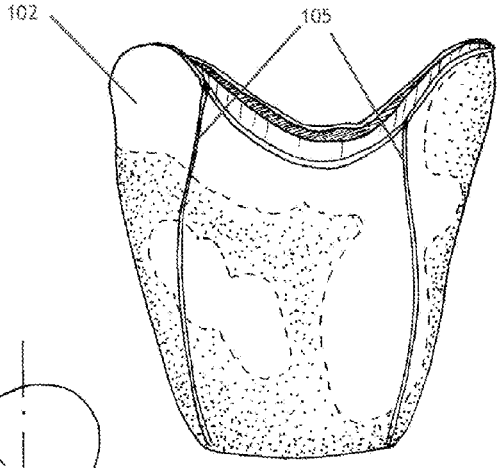
FIG. 5 illustrates a back elevation view of the same insert illustrated in FIG. 4.

FIGS. 4 and 5 illustrate the front and back elevation views, respectively, of the pointe shoe insert, with dotted regions (bounded by dashed lines) indicating one possible example of the location of the cured moldable impression material on the inside of the supportive cover 102 for a tapered toe configuration (left foot). It will be seen that the moldable impression material 103 generally covers most of the top of the foot, while leaving more surfaces exposed on the bottom of the foot so that the metatarsals and pads of the toes can better contact the floor when standing on flat, eliminating any feelings of bulkiness under the ball of the foot. The supportive cover 102 has several functions: to allow the cured pointe shoe insert 104 to be easily and securely slipped over the toes (like a sock tip) before being inserted in the pointe shoe, to lend form and structural support to thinner (and perhaps separate, discrete) parts of the molded impression material 103, and to enhance the aesthetics of the insert 104. The moldable impression material 103 actually impregnates the supportive cover 102 during the fitting process (represented by the dotted regions), and thus the supportive cover 102 may provide a canvas or "base" for even the thinnest layers of the moldable impression material 103. Without the presence of the thinner or more delicate parts of the molded casting of the foot, its ability to form a truly glove-like (and surface-maximizing) fit may not be fully optimized. In a preferred embodiment, the supportive cover 102 may be made from a sport wick-away knit fabric, possibly containing Lycra®, for reasons of perspiration management inside the shoe and for the ability to stretch around the contours of the foot. In another possible embodiment, the supportive cover 102 could be lined with a thin coating of gel or foam so as to enhance the blister protection of the pointe shoe insert 104. The insert 104 may be designed to address the uneven distribution of pressure inside the shoe, and while this may reduce points of friction as well, this is a separate problem that may require a separate solution. In yet another possible embodiment, the supportive cover 102 could be reinforced in selected areas (particularly around the big toe) with another layer of fabric, gel, rubber, or dense foam to increase its durability and add strength to un-impregnated areas of fabric (or areas coated with only a very thin layer of the moldable impression material) that are subjected to concentrated forces (like around the big toenail) and might otherwise be susceptible to tearing. Additional embodiments of the supportive cover 102 may further be customized with respect to 1.) how it is cut on the top to mirror the throat of the pointe shoe (and not extend beyond it), and 2.) how the stitching lines 105 on the bottom mirror the insole of the shoe. If the stitching lines were directly on the sides of the supportive cover 102, they could potentially irritate the bunion area or sides of the foot. A seamless stretch supportive cover 102 would also eliminate this problem.

Figure 6:
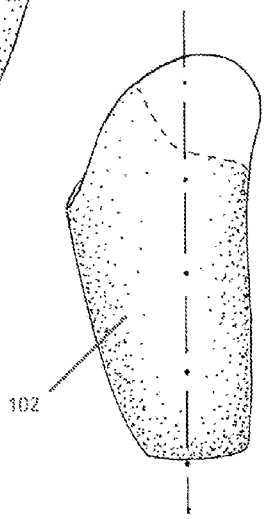
FIG. 6 illustrates a side elevation view of the same insert illustrated in FIG. 4.
Figure 7:
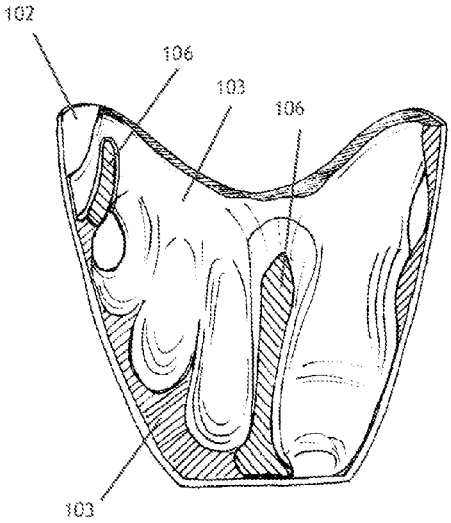
FIG. 7 illustrates a cross-sectional view of the top half (covering the top of the foot) of the same insert illustrated in FIG. 6, relative to the indicated center line.
Figure 8:
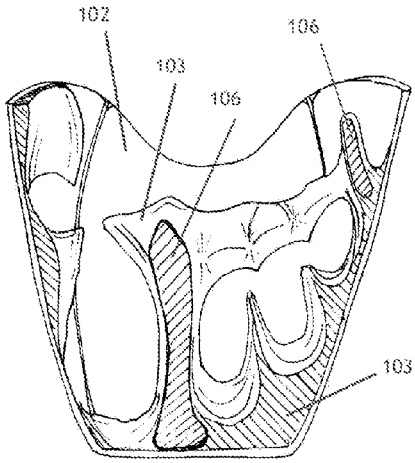
FIG. 8 illustrates a cross-sectional view of the bottom half (covering the bottom of the foot) of the same insert illustrated in FIG. 6, relative to the indicated center line.

FIG. 6 illustrates a side elevation view of the pointe shoe insert 104, looking at the outside (pinky toe) side of the foot. FIGS. 7 and 8 show cross-sectional views of the top and bottom halves, respectively, of the insert 104 relative to the indicated center line illustrated in FIG. 6. Opened like a clam shell, it is now more evident how the moldable impression material 103 very precisely contours itself to individual toes, and can fill even the shallowest voids within the box of the shoe. Looking at FIG. 7, it can be seen that for this dancer's foot (remember that this is only one possible example of an infinite variety of possible moldings), the greatest pressure points would typically occur at the tip of the big toe, the bunion, the knuckle of the fourth toe, and the side of the pinky toe, since the moldable impression material 103 is thinnest (or not present) at these points. But because the material has substantially filled the voids around these areas, the dancer will find the pressure greatly reduced at those points. Looking at FIG. 8, it can be seen that the moldable impression material 103 actually flowed underneath the toes to fill the ridge-like cavity between the heads of the metatarsals and the pads of the toes. This additional surface area of the foot now bearing the dancer's weight again helps to equalize pressure and maximize the support felt inside the shoe.

Also to note are the custom-molded spacers 106 integrated into the moldable impression material in FIGS. 7 and 8. Though illustrated between the first/second and fourth/fifth toes, spacers 106 could conceivably be placed anywhere where the dancer has a need. In this case, the big toe spacer 106 keeps the big toe more vertically aligned, which will help prevent the onset of bunions. Smaller spacers 106 between the smaller toes can help prevent the formation of soft corns or blisters between overly cramped adjacent toes, or even one toe becoming gradually (and perhaps permanently) nested underneath another. The spacers can be formed/integrated in a variety of ways, which will all be discussed further during the explanation of the fitting process.

Figure 9:
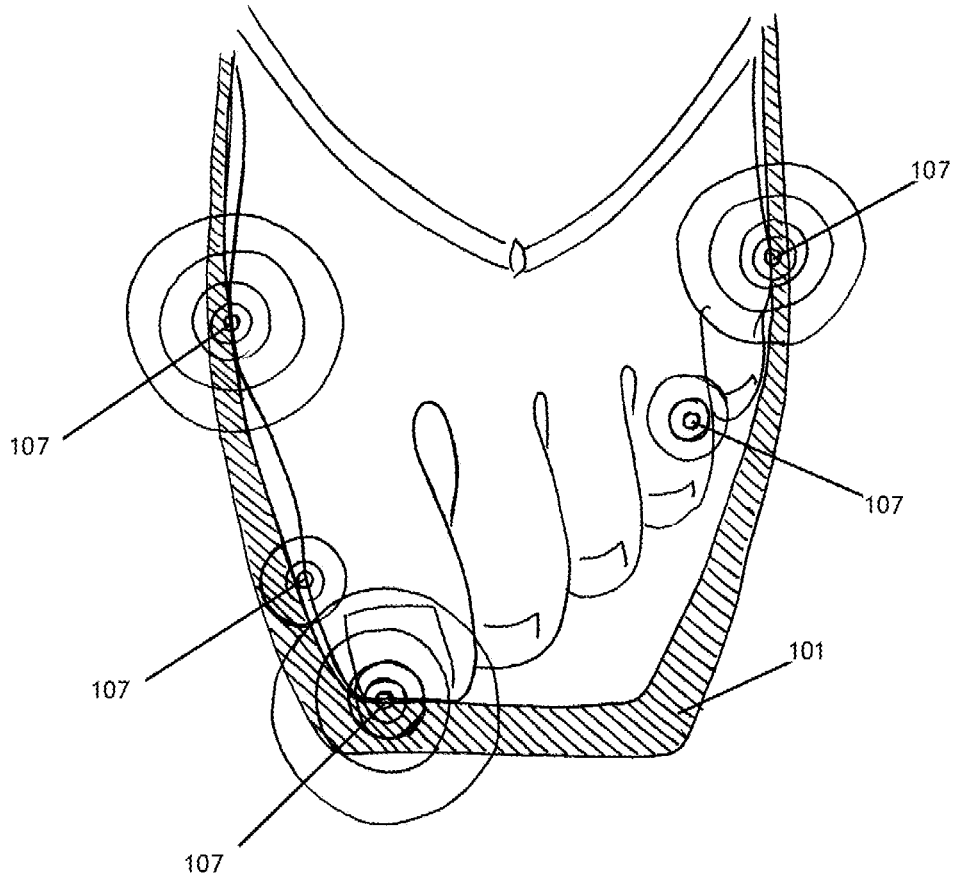
FIG. 9 illustrates a cross-sectional view of a dancer's foot en pointe in an unmodified shoe (e.g., without any insert) and a variety of common high pressure points that could potentially develop as a result of the disparity between the shape of the symmetrical shoe box interior and a natural toe configuration (in this case, tapered toes). The weight of the dancer is distributed over only a few small surfaces in contact with the shoe. It also illustrates the potential for bunion formation or overlapping toes that may occur if spacers are not used.

The discussion will now turn to the concept behind filling the voids within the box of the shoe, and the need for using a moldable impression material 103 to do so. FIG. 9 shows a cross-sectional view of a dancer's foot en pointe, wearing nothing but an unmodified shoe. It is clear that a variety of high pressure points 107 could potentially develop as a result of the disparity in shape between the symmetrical shoe box 101 and a natural toe configuration (in this case, tapered toes). Such a foot might experience the most pain on the longest toe, the sides of the foot where they contact the shoe, or even on the tops of knuckles that press against the top of the shoe (as illustrated on the fourth toe). Note that the greatest pressure point might not always be on the tip of the longest toe. The problem becomes dramatically worse when the dancer stands en pointe, for her entire body weight is distributed over only a few small surfaces in contact with the shoe. As discussed previously, these high pressure points 107 and unbalanced weight distribution not only cause short-term ailments (blisters, black toenails, calluses, etc.), but more serious, long-term damage as the result of accumulated stress (bunions, hammertoes, bone spurs, and other deformities).

FIG. 9 also illustrates the potential for bunion formation or overlapping toes without the use of spacers. It is clear how the tapered shape of the shoe, combined with a great deal of the body's weight resting upon the big toe, is causing this toe to angle inward, which will eventually enlarge the base of the toe joint to form a bunion.

Inserts that are customized according to embodiments of the present invention resolve these issues by creating a highly individualized, supportive, and customizable fit that distributes the weight more evenly over a greater percentage of the surfaces of the toes and forefoot, while keeping the toes naturally spaced and aligned as needed. This "perfect fit" is accomplished through the application of a moldable impression material 103 that has the ability to freely flow to all the voids within the box of the shoe for infinite customization.

Figure 10A:
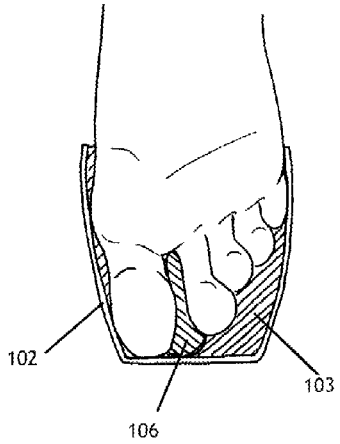
FIGS. 10A-10C illustrate back, cross-sectional views of three different dancers' feet, each supported by an insert customized in accordance with an exemplary embodiment of the present invention while en pointe.
Figure 10B:
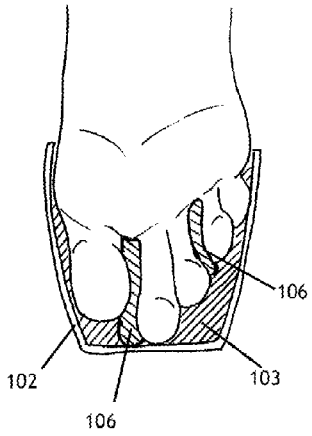
Figure 10C:
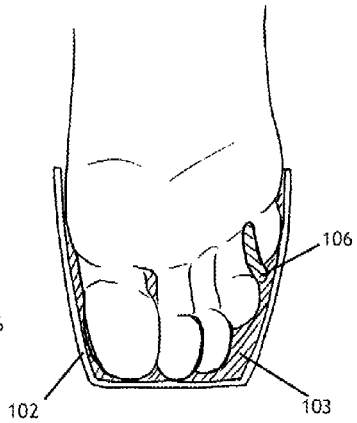

FIGS. 10A-10C illustrate three possible embodiments of the insert 104 as they would most likely appear for the three exemplary toe configurations: tapered toes, longer second toe, and square toes. The insert 104 is shown in cross section supporting these three unique toe types en pointe to illustrate how the moldable impression material 103 can accommodate an infinite variety of toe configurations, including, but not limited to, those illustrated here. In each case, the insert 104 distributes the dancer's weight more evenly across the surfaces of her toes and forefoot. In the tapered toe configuration shown in FIG. 10A, the moldable impression material 103 flows to the void under the shorter toes to take pressure off the big toe. In the longer second toe configuration shown in FIG. 10B, moldable impression material 103 underneath both the big toe and the other shorter toes serves to take pressure off the longer second toe, which might otherwise develop into a hammertoe with time. In the square toe configuration (already most naturally suited for pointe work) shown in FIG. 10C, the moldable impression material 103 will most likely primarily fill the void on the top of the forefoot (to be discussed shortly) and the void under the tips of only the fourth and fifth toes. For dancers who experience pressure on their longest toe, the moldable impression material 103 essentially distributes the dancer's weight more evenly across the tips of all of her toes by effectively dispersing the vertical load along 5 toes of equal length (as well as over any other surfaces of the forefoot contacted by the moldable impression material 103). Besides improving the comfort, this also has the effect of making the dancer feel more stable. It will reduce the tendency for the beginning dancer to "sickle out" (letting her ankles bow outward as she centers her weight towards her smaller toes) if she feels even support under all her toes. Correct ankle alignment is essential for the development of proper technique built upon a good foundation and the prevention of other injuries.

FIGS. 10A-10C also illustrate how the moldable impression material 103 does not interfere with the dancer's ability to "feel the floor" while en pointe. The longest toe(s) still maintains good connection with the floor for purposes of stability and control, yet without the pain that typically accompanies the sole weight-bearing toe when the rest of the shorter toes are unsupported. Simply adding extra thick cushioning under the longest toe(s), which often take the greatest beating, might aid slightly with comfort, but leads to the awkward, unstable, and unsafe feeling of being slightly elevated off the floor, or in the case of a thick gel pad, floating on a waterbed. As such, the insert 104 allows the dancer to maintain this crucial connection to floor while simultaneously improving comfort by evenly supporting the other toes and other surfaces of the forefoot. If, however, the dancer's personal preference was still to feel less of the floor while en pointe, the insert 104 could be modified by adding a thin layer of padding to the "platform" of the insert (the flat semi-circular area that nests in the squared-off tip, or platform, of the shoe). Such an embodiment could be accomplished by either sewing a semi-circular cushion (made of gel or another shock-absorbing material) into the tip of the supportive cover 102 or slipping it into a pocket in the tip of the supportive cover 102, or perhaps most easily and simply, by applying an adhesive version of such a cushion to the outside of the supportive cover 102 after the insert has molded. It is understood that any such possible adaptation that further increases the customizable nature of the insert and caters to the individual dancer's unique needs by affording an optional integration of a layer of padding in the platform area of the insert are considered within the scope of the present invention.

FIGS. 10A-10C also illustrate how the moldable impression material 103 may flow to more shallow voids (in addition to the large void underneath the tips of the shorter toes), such as around the bunion or tailor's bunion, to relieve pressure near those spots. It also illustrates several potential embodiments for custom-molded spacers 106, or any other type of spacers, being integrated into the insert depending on the individual's foot anatomy and unique needs.

Figure 11:
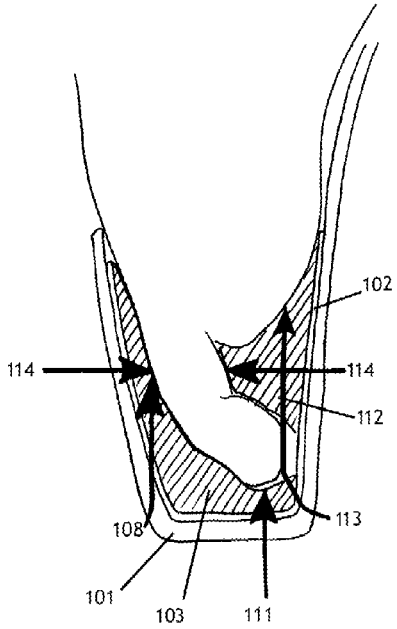
FIG. 11 illustrates a cross-sectional view of an insert customized in accordance with an exemplary embodiment of the present invention for a tapered toe configuration taken along the line of the second toe, illustrating how the moldable impression material can maximize all useful weight-bearing surfaces of the toes and forefoot.
Figure 12:
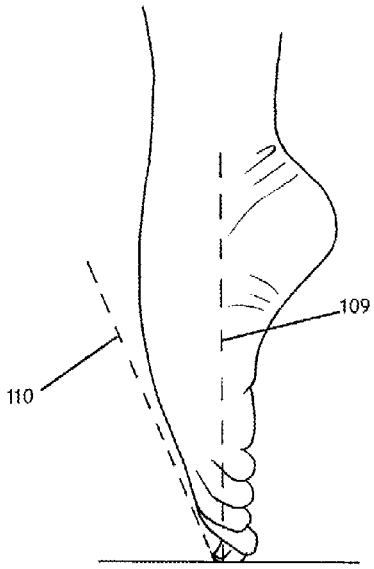
FIG. 12 illustrates the outside of a dancer's foot when positioned en pointe, illustrating how the over-vertical angle formed by top of her foot may create a potentially useful weight-bearing surface on the top surfaces, in addition to the tips, of her toes.

FIG. 11 shows a cross-sectional view of an embodiment of an insert for a tapered toe configuration taken along the line of the second toe, clearly illustrating how the moldable impression material 103 not only fills the voids length-wise within the box of the shoe (as was evident in FIGS. 10A-10C), but the voids depth-wise. The moldable impression material 103 can substantially fill the voids not just between the tips of the toes and the platform of the shoe, but also flow over the tops of, and even underneath, the toes. The benefits of having moldable impression material 103 on both the tops and bottoms of the toes are manifold. First, the added surface area of the insert in contact with the foot only serves to increase its weight-distributing capability. The moldable impression material 103 situated between the top (dorsal) side of the foot and the vamp of the shoe can supply an upward vertical force 108 on the angled surface of the forefoot, as seen in FIG. 11, using a combination of the normal and frictional forces (the vertical components of both vectors). Referring momentarily to FIG. 12, it is clear that when the dancer's foot is correctly placed en pointe, the dorsal (top) surface of her forefoot is actually past the vertical line 109 formed normal to the floor. This creates a potentially useful, weight-bearing angled surface 110 upon which the dancer can be supported. Thus by supporting the top surface of the toes, a certain amount of "lift" can be generated, in addition to the force 111 which is felt directly under the tips of the toes, as seen in FIG. 11. Another potentially useful weight-bearing surface is the cavity 112 between the heads of the metatarsal and the pads of the toe. Moldable impression material 103 that flows in this cavity is also able to exert an upward vertical force 113 that further improves the weight-distributing properties of the insert.

Another benefit of material on the top and bottom surfaces of the toes besides increased weight distribution is for reasons of correct technique and alignment. Beyond increased comfort and damage prevention, this added support has several key performance benefits. Although many dancers tend to curl their toes when they point their foot, correct technique when en pointe is to point with the arch while lengthening the toes. As seen in FIG. 11, the moldable impression material 103 can provide gentle horizontal forces 114 that keep the toes lengthened, in addition to the vertical lift forces just discussed. Provided that the dancer makes a conscious effort to keep her toes lengthened during the molding process, the cured insert will help encourage correct alignment of the toes much in the same way braces or a retainer guide the movement and eventual placement of teeth. Not only do these horizontal forces 114 help the dancer train successfully by developing correct technique, but they can prevent the knuckles of the shorter toes from becoming a pressure point against the top of the shoe. By applying an even pressure to the entire top surfaces of the toes through a glove-like fit, any undue pressure on individual knuckles is eliminated, thus reducing the chance for developing painful and unsightly calluses or hard corns.

The discussion will now turn to the fitting process. It is imagined that the dancer could easily self-fit her pointe shoe inserts 104 at home, though it is also conceivable that they could be fit in the store with the guidance of the shoe fitter.

Notwithstanding, the fitting process allows for simplicity and convenience, as well as true customizability, in preparing a pointe shoe insert 104. Furthermore, embodiments of the present invention are not only compatible with a variety of future developments, such as changes to the approach and philosophy behind fitting pointe shoes, but they could also influence such developments. Typically, in order to achieve the desired glove-like fit and produce the required level of support, the foot is fit very tightly inside a pointe shoe, essentially forcing the foot to take the shape of the shoe. Embodiments of the present invention solve this problem by introducing a mediating material (e.g., moldable impression material 103) that adapts the interior geometry of the shoe to support and match the foot. Use of such moldable impression material 103 could actually allow pointe shoes to be safely fit slightly larger/wider than normal, since the moldable impression material 103 allows for maintenance of a snug fit, but not to the point of over-compressing the foot. This would prevent the uncomfortable and potentially harmful over-compression of the metatarsals, and allow the moldable impression material 103 to perform its natural function of supporting the foot more evenly by filling in the voids in the box. However, assuming the pointe shoe is already correctly fit, the dancer will not be forced to alter her shoe size at all. The insert 104 is completely self-adjusting in terms of volume; any excess material escapes during the fitting process so that the moldable impression material 103 only fills the voids within the shoe and introduces no additional bulk.

In the preferred embodiment, the moldable impression material 103 includes a silicone rubber impression material, made from a two-part polyvinylsiloxane, which is ideal for yielding highly customized impressions and fine-resolution molding, offering the user flexibility and choice in the quantity applied, and affording a very simple, user-friendly, mass-customizable process. Examples of such moldable impression material 103 may include a product called Dur-a-Sil Equal™, manufactured by Insta-Mold Products, Inc. in Oaks, Pa. (www.instamold.com). With a durometer of only 20-22 on the Shore A hardness scale, such moldable impression material 103 cures into a cushiony soft and stretchable rubber that provides firm support for the foot en pointe, while also allowing enough resilience to absorb impact and flex with the foot and toes as they change position while dancing. Such moldable impression material 103 also has a relatively low viscosity in its uncured putty state, which affords complete freedom to flow to the voids within the shoe, and reduces feelings of tightness/pressure during the molding process. There is no sagging of the material while curing because of its thixotropic properties, producing an accurate casting of the foot. Such moldable impression material 103 is also characterized by dimensional stability (virtually no shrinkage over time), meaning it will not compress under the repeated impact from the toes and will produce a durable insert. Best of all, such moldable impression material 103 is user-friendly and extremely easy to work with, making it accessible to every dancer and conducive to mass customization. Such moldable impression material 103 only requires mixing of different-colored putties to activate the chemical reaction (as opposed to adding a curing agent with an eyedropper), and then cures quickly in 5-8 minutes. In a preferred embodiment, such moldable impression material 103 will be packaged in two sets of resealable containers/packaging, which will afford the dancer the freedom to select whatever volume of putty she so desires (based both on her personal preferences, as well as her shoe size). Each set, comprised of equal parts of both colors, will contain a pre-measured amount sufficient for one foot, but if the dancer chooses not to use all of the material, she may reserve the rest for future use in molding a new pair of inserts. Such moldable impression material 103 may also be formulated with medical-grade mineral oil to facilitate easy removal from skin. Once cured, the silicone rubber will not absorb sweat (or odors), and can be cleaned easily with soap and water, or even sanitized with rubbing alcohol. As it is heat-resistant, as well, it is conceivable that the insert 104 could simply be cleaned in the washing machine.

One possible embodiment for the moldable impression material 103 includes thermoformable EVA foam. This static moldable material can be used to achieve fairly high-resolution moldings and has excellent memory for this molded shape, but may be more difficult to work with, given several of its inherent material properties (e.g., remaining solid even in its heated (and gelatinous, pliable) state). It can, at best, only compress and contour itself around surfaces to which it is molded; actually relocating and freely moving around to escape from the points of pressure and fill only the voids (or even exit the shoe in the case of too much volume) is impossible. Some dancers may find that the foam indeed molds and contours around their toes, yet creates a feeling of overall "tightness"/compression due to this limited mobility and freedom of the foam.

Yet another possible embodiment for the moldable impression material 103 includes flowable solutions. One advantage of flowable solutions is they have the potential to provide a more "active" fit that responds to and maintains support as the foot and toes change position. Such mixtures may include formulations that include finely granulated cork and petroleum jelly, as well as various viscous gels and clay-like materials such as poster putty wall tack. While a variety of flowable materials contained inside small pouches/bladders may serve as the moldable impression material 103, some may have disadvantages, such as difficulty in adjusting the volume needed to fill the voids inside the shoe. Different size pouches may be used, but they cannot be trimmed or shaved like a solid, and draining/filling/sealing them would present serious challenges. In addition, it may be quite difficult to contain the material where needed without it eventually flowing away and accumulating at the edges of the pouches/bladders. Guiding channels and a pumping system could be devised, but it is an added engineering problem. Also, the material eventually settles over time, so each time the foot is re-introduced in the shoe, the insert would take time to warm up and re-mold itself to the foot. In contrast, when silicone rubber impression material is used, the cured moldable impression material 103 never changes shape, and feels like the same familiar fit the second it is slipped on. Further, there is always the risk of puncture or rupture, and with the toenails and high pressures experienced inside the shoe, this could be a real possibility.

Considering that the silicone rubber moldable impression material avoids any of the disadvantages described above, it is the preferred embodiment. It combines the best of both worlds: the uncontained freedom of a viscous fluid to contour exactly to the toes and easily flow to low-pressure voids (while in its uncured state), and the stability and support of a solid (once cured). Since the foot does not change shape that dramatically when moving from flat to pointe inside a pointe shoe (given that the toes do not have much space to move in the first place in such a snug-fitting shoe), the inventor has found that a static molded material with adequate softness and elasticity, such as the cured silicone rubber impression material, provides enough flexibility to move with the foot as it changes position.

FIGS. 13 and 14 show the first step in the process of fitting the pointe shoe insert: determining the need for, and placement of, spacers. This can be determined by observing where there are natural spaces between adjacent toes (in particular between the first and second toes), or where the smaller toes might show a tendency to overlap. These figures illustrate only one possible placement for spacers. The spacers could be created and/or incorporated in a variety of ways. As is illustrated in FIG. 13, they could be custom-fashioned from the same silicone rubber moldable impression material 103 used to create the rest of the insert 104 (or a similar, lower durometer formula), which would create a very precise-fitting, custom-molded spacer 106. By this method, the dancer would first apply some moldable impression material 103 between her toes and then allow the spacers 106 to cure (with her foot relaxed, outside of the pointe shoe) before moving on to the next step. This is crucial in ensuring that the moldable impression material 103 does not escape prematurely from the space and partially vacate the void whose purpose it was to fill when the foot is introduced into the shoe and the shoe applies compressive forces to the toes.

FIG. 14 shows a second possible embodiment for incorporating spacers: simply inserting pre-formed spacers 115 designed to interface with the moldable impression material 103. In this case, the illustrated spacers 115 are made from fabric-faced silicone gel, where the fabric facing (likely bonded to the gel during manufacturing) creates a surface to which the moldable impression material will adhere during the fitting process. Silicone gel spacers 115 that are perforated with "grab" holes or that have a rough, sandblasted surface are other possible ways to afford their integration with the moldable impression material 103. Another possible embodiment would include a dense, open-celled foam spacer 115 which the moldable impression material could actually partially impregnate.

FIGS. 15A-15C show a third possible embodiment for incorporating spacers, whereby a dancer can easily adapt and use standard pre-formed silicone gel spacer products already found on the market and in widespread use by simply covering them with a stretch fabric sleeve 116. When stretched over different styles of spacers, the sleeve 116 provides a surface to which the moldable impression material 103 can adhere. FIGS. 15A and 15C illustrate two common shapes of silicone gel spacers: an elliptical cylinder with an hourglass curve 117, and an asymmetrical parabola of uniform thickness 118, respectively. The fabric sleeve 116 (shown in FIG. 15B) stretches over the hourglass cylinder spacer 117 like a tube, covering the vertical walls. The same fabric sleeve 116 can also be stretched over the asymmetrical parabola spacer 118 so that it covers most of the middle section. In both cases, this fabric sleeve 116 serves to provide a micro-porous surface onto which the moldable impression material can grab, thus "anchoring" the spacer in the insert 104; without it, the smooth-surface silicone gel spacer could fall out of the molded insert 104, making it a hassle to correctly re-position inside the molded insert 104 each time it is worn.

It is also worth noting that the moldable impression material 103 will most likely form some thin walls between adjacent toes naturally during the molding process. While these walls might lack the thickness to be effective space-holders and maintain the straight alignment of the toes, many dancers will find that they eliminate the need for tape. These membrane-thin walls may provide, for example, blister protection between adjacent toes, and spare the dancer the time and effort needed to individually wrap toes with tape for this purpose.

It is crucial to note that the pointe shoe may need to be fitted with the spacers in place between the toes so as to accommodate for this volume. If the toes are already squeezed inside a shoe, simply adding a spacer (or two) may only increase the pressure inside the shoe and exacerbate the problem. Thus, if the dancer's shoes have not already been fit to allow for a spacer, the dancer may need to get fitted for a new pair of shoes before proceeding at this point. Such practices and precautions can ensure adequate width at the platform and in the box of the shoe so as to comfortably keep the toes open in their natural alignment.

Figure 16:
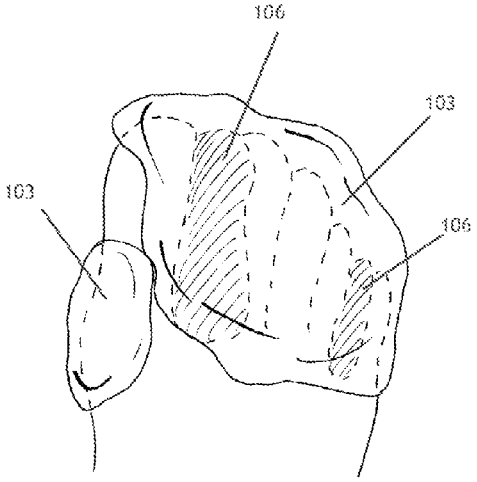
FIG. 16 illustrates a next step in the process of customizing an insert in accordance with an exemplary embodiment of the present invention: applying moldable impression material to the toes and forefoot (over any spacers, if elected for incorporation into the insert).
Figure 17:
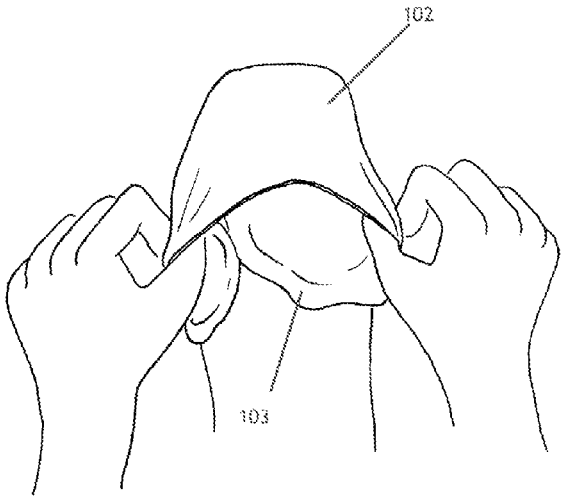
FIG. 17 illustrates another step in the process of customizing an insert in accordance with an exemplary embodiment of the present invention: applying the supportive cover over the moldable impression material.
Figure 18:
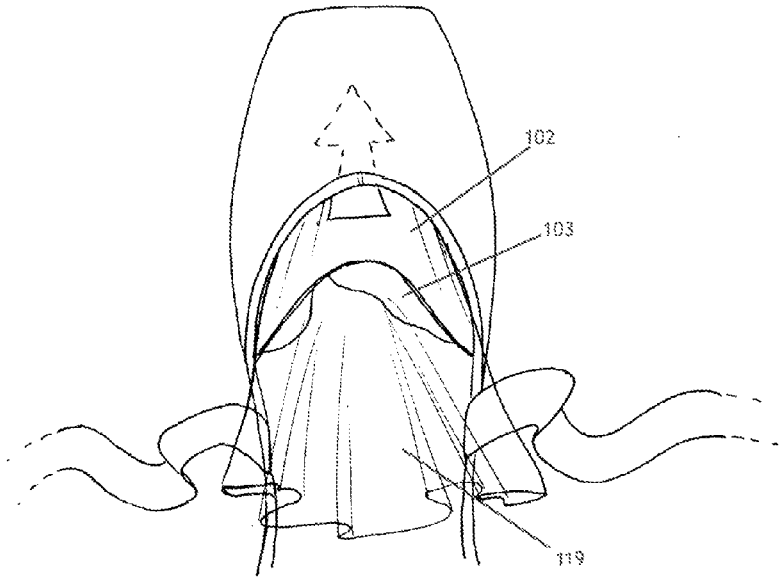
FIG. 18 illustrates yet another step in the process of customizing an insert in accordance with an exemplary embodiment of the present invention: putting on the shoe after covering the insert with a plastic bag to protect the shoe interior.

FIG. 16 shows the second step in the insert fitting process: mixing the moldable impression material 103 and applying it to the bare toes and forefoot. The inventor has found that a volume of approximately 33 mL (25 g) per foot of the silicone rubber moldable impression material 103 is usually adequate to fill the voids in most dancers' shoes. The dancer simply mixes equal parts of putty until the colors blend (e.g., about 30 seconds), and then applies the moldable impression material 103 around her toes, covering over any spacers (in this case, custom-molded spacers 106) which she might have elected to integrate in her custom insert 104. It is recommended that she liberally cover the tops and tips of all her toes, and make an effort to cover any known pressure points, although the precise placement of the moldable impression material 103 is not imperative since it is self-fitting and naturally flows to low-pressure zones in the shoe. Adding a bit of moldable impression material 103 behind the toes may ensure the availability of material to fill those voids, as often times the presence of spacers (or just closely-spaced toes) impedes the flow of the moldable material to the back of the toes once inside the shoe. If desired, the dancer may elect to only selectively apply reduced amounts of moldable impression material 103 to certain known pressure areas (e.g., around the bunion and across the metatarsal if bunions are a known pressure point) if she prefers a less glove-like fit for the sake of greater freedom for her toes. The dancer always has the option to go back and add additional moldable impression material 103 at a later time to her molded insert 104 if she changes her mind. The dancer then slides the supportive cover 102 over the moldable impression material 103, as illustrated in FIG. 17. The dancer then covers her foot with a protective plastic bag 119 (to prevent the moldable impression material, which will seep through the supportive cover, from adhering to the canvas lining of the shoe), and as shown in FIG. 18, slips her foot into the pointe shoe.

Figure 19:
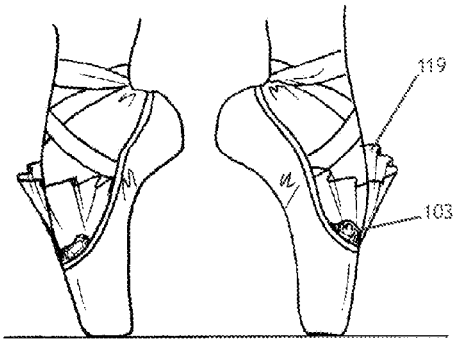
FIGS. 19-21 illustrates still yet another step in the process of customizing an insert in accordance with an exemplary embodiment of the present invention: alternating between the "pointe" (FIG. 19), "demi-pointe" (FIG. 20), and "flat" (FIG. 21) positions for several minutes while the moldable impression material flows to the voids in the box of the shoe and cures (and the excess volume escapes from the throat of the shoe).
Figure 20:
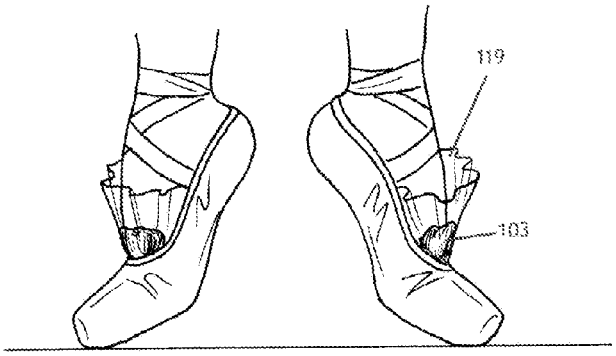
Figure 21:
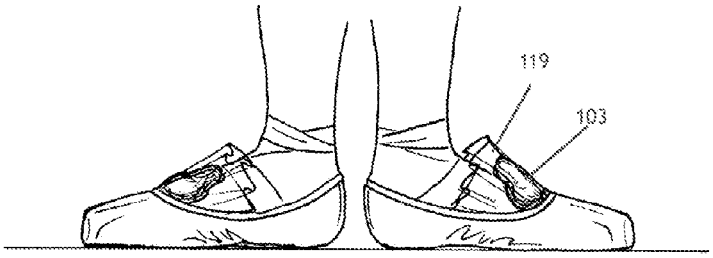

FIGS. 19-21 show the dancer alternating between the "pointe," "demi-pointe," and "flat" positions for several minutes while the moldable impression material flows to the voids within the box of the shoe, and slowly cures and adjusts over the course of about 5-8 minutes. Articulating through these various positions may ensure that the final casting is a blend of them all, and that the foot (and toes) feel comfortable and unrestricted in all positions. It will also be noted how the excess volume of the moldable impression material 103 escapes from the throat of the shoe during the course of the molding process, but is contained inside the plastic bag 119. As mentioned earlier, the dancer should take care during this stage to ensure that her toes are correctly aligned and lengthened, so that the resulting impression may act as a training tool to remind her muscles of the correct placement of her toes.

Figure 22:
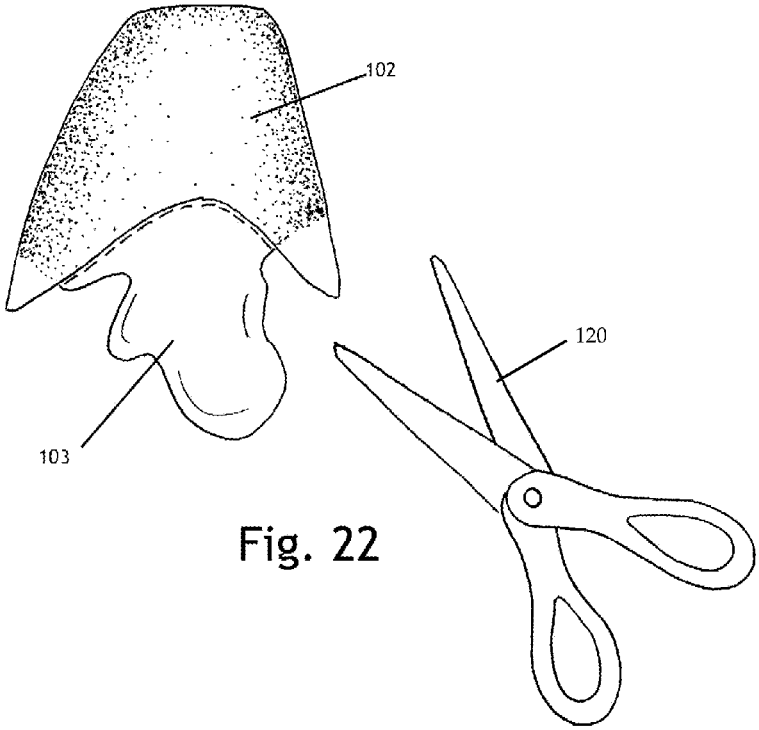
FIG. 22 illustrates another step in the process of customizing an insert in accordance with an exemplary embodiment of the present invention: trimming the excess cured impression material along the line of the supportive cover.

Once the material has cured (a quick squeeze of the escaped material to check for firmness allows the dancer to determine when the insert is finished curing), the dancer may remove the shoe, plastic bag 119, and molded insert 104 from her foot. Finally, she may trim the excess cured moldable impression material 103 along the line of the supportive cover 102 with scissors 120, as shown in FIG. 22. The dancer is now ready to repeat the process for her other foot.

Figure 23:
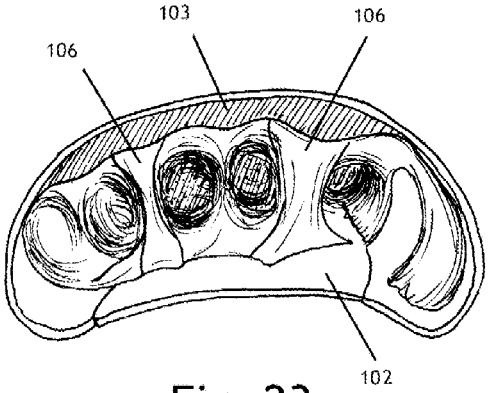
FIG. 23 illustrates an interior view looking down into the platform (or tip) of a completed insert customized in accordance with an exemplary embodiment of the present invention.
Figure 24:
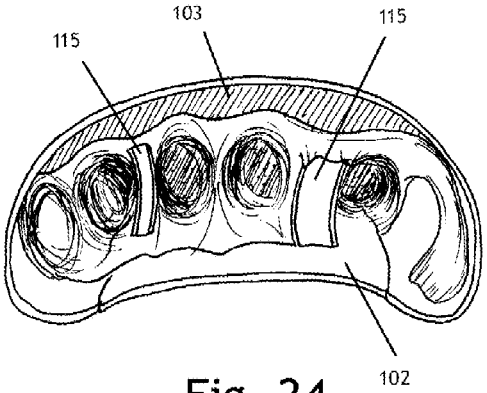
FIG. 24 illustrates the same view as FIG. 23, but with pre-formed spacers incorporated between the first/second and third/fourth toes.

Upon examining the inserts, the dancer will now see how they have perfectly conformed to the shape of her toes (and to the inside of the shoe), and have substantially filled in the voids around her toes. FIGS. 23 and 24 show the view looking down into the platform (or tip) of an embodiment of a completed insert for a left foot with custom-molded spacers 106 and pre-formed spacers 115, respectively, incorporated between the first/second and third/fourth toes. Although she will see that the thinnest points of the insert (if held up to the light) are around her areas of greatest pressure, she will now feel very little pressure in those regions when en pointe because the load is carried by all the other surfaces of the foot in contact with the insert. Though perhaps counterintuitive at first to not pad these pressure points, the dancer will find that her custom inserts much more successfully deal with the day-to-day pain of pointework, and furthermore, provide the support and alignment to keep her feet healthy over the course of her dance career.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A method for customizing an insert for a ballet pointe shoe of a dancer, the method comprising:

preparing a moldable impression material;

applying the moldable impression material to a portion of a forefoot of a foot of the dancer, wherein a portion of the applied moldable impression material conforms to a shape of the portion of the forefoot;

layering a supportive cover over and surrounding the applied moldable impression material prior to inserting the foot and the applied moldable impression material into the ballet pointe shoe, bonding and impregnating the supportive cover with the applied moldable impression material, the supportive cover providing structure and support to the applied moldable impression material;

inserting the foot and the applied moldable impression material into the ballet pointe shoe of the dancer, wherein a portion of the applied moldable impression material conforms to a shape of the ballet pointe shoe;

adjusting the foot of the dancer into one or more positions while the applied moldable impression material cures, wherein the applied moldable impression material fills one or more voids between the portion of the foot and the ballet pointe shoe; and trimming a resulting molded insert formed by the applied moldable impression material after the applied moldable impression material is completely cured, the insert is held in place on the foot of the dancer by the supportive cover.

2. The method of claim 1, further comprising layering a protective plastic bag over the applied moldable impression material prior to inserting the foot and the applied moldable impression material into the ballet pointe shoe.

3. The method of claim 1, further comprising positioning a spacer between two adjacent toes in the portion of the foot of the dancer prior to applying the moldable impression material to the portion of the forefoot.

4. The method of claim 3, further comprising adapting the spacer by placing the spacer in a sleeve prior to applying the moldable impression material to the portion of the forefoot.

5. The method of claim 1, wherein the moldable impression material includes silicone rubber.

6. The method of claim 1, wherein the moldable impression material includes two putties, each putty having a different color and wherein preparing the moldable impression material comprises mixing the two putties together until the colors are blended.

* * * * *